United States Patent [19]

Stewart

[11] Patent Number: 4,541,217

[45] Date of Patent: Sep. 17, 1985

[54] DOUBLE ROW SHINGLE ALIGNMENT FIXTURE

[76] Inventor: Franklin D. Stewart, 10101 Singing Oaks Ct., Tampa, Fla. 33615

[21] Appl. No.: 505,916

[22] Filed: Jun. 20, 1983

[51] Int. Cl.[4] ..... E04D 1/00

[52] U.S. Cl. ..... 52/518; 33/188; 52/748

[58] Field of Search ..... 52/747, 748, 749, 518, 52/127.1; 33/404, 411, 187, 188

[56] References Cited

U.S. PATENT DOCUMENTS

| | | | |
|---|---|---|---|
| 154,522 | 8/1874 | Schramm | 33/188 |
| 738,256 | 9/1903 | Tinklepaugh | 33/188 |
| 1,035,062 | 8/1912 | Vroome | 33/188 |
| 1,192,651 | 7/1916 | Leonard | 33/188 |
| 3,110,113 | 11/1963 | Baker | 33/188 |
| 4,110,911 | 9/1978 | Sucheck | 33/188 |
| 4,285,134 | 8/1981 | Schmanski | 33/187 X |

*Primary Examiner*—Donald G. Kelly
*Assistant Examiner*—Naoko N. Slack
*Attorney, Agent, or Firm*—Stein & Reese

[57] ABSTRACT

A double row shingle alignment fixture is disclosed for aligning rows of roofing shingles. The fixture includes a first longitudinal panel having a grooved lower flange with a lower edge and a plurality of grooves adapted to be aligned with a first row of shingles. The first longitudinal panel further includes a second flange on the opposite side thereof for abutting with the lower edge of a second row of shingles and a plurality of first alignment pegs thereon for alignment with the slots in the second row of shingles. The fixture further includes a second longitudinal panel hingedly mounted to the first longitudinal panel along a longitudinal axis to be folded down on top of the second row of shingles after being fastened to the roof. The second panel has an upper flange for abutting with the lower edge of a third row of shingles and a plurality of second alignment pegs thereon for alignment with the slots in the third row of shingles. The second alignment pegs are longitudinally aligned with the grooves in the lower flange. In this manner, the second and third rows of shingles can be aligned with the first row.

10 Claims, 3 Drawing Figures

DOUBLE ROW SHINGLE ALIGNMENT FIXTURE

FIELD OF THE INVENTION

The invention disclosed broadly relates to improvements in hand tools and more particularly relates to improvements in roofing shingle alignment fixtures.

BACKGROUND OF THE INVENTION

Asphalt shingles have become a widely used roofing material, giving protection and many years of service. These shingles typically come in longitudinal strips having two transverse slots therein forming three rectangular portions which project downwardly from an upper longitudinal body portion. The first step in applying this type of roofing is to cover the roof with roofing felt. The bottom most row of shingles is then nailed into place along the eaves of the roof and along gable ends. Successive rows of shingles are applied from the eaves upward to the ridge of the roof. Building codes for most jurisdictions are very precise as to the spacing and fastening of the shingles to the roof. The most popular dimension for asphalt shingles is a longitudinal dimension having a nominal value of three feet with a tolerance of plus one-eighth inch and minus zero. The building codes which treat this size asphalt shingle state that the shingles must be positioned on centers which are no greater than three feet and one-eighth inch apart with rows having a width in the upward transverse direction of approximately five inches. It takes great skill and stamina to lay asphalt shingles all day in the hot sun and yet to maintain these stringent dimensions. There have been several attempts in the prior art to provide alignment devices for laying asphalt shingles but they generally are cumbersome to operate and are inefficient to use since they must be repositioned after every row of shingles has been laid down.

OBJECTS OF THE INVENTION

It is therefore an object of the invention to provide an improved way to align roofing shingles when they are being laid down.

It is another object of the invention to provide an improved roofing shingle alignment fixture which is more efficient to use than has been available in the prior art.

SUMMARY OF THE INVENTION

These and other objects, features and advantages of the invention are accomplished by the fixture disclosed herein. A double row shingle alignment fixture is disclosed for aligning rows of roofing shingles. The fixture includes a first longitudinal panel having a lower flange with a lower edge adapted to be aligned with the lower edge of a first row of shingles, the lower flange having a plurality of grooves therein for alignment with the slots in the first row of shingles. The first longitudinal panel further includes a second flange on the opposite side thereof, having an upper surface separated from the lower edge of the lower flange by a row width dimension, for abutting with the lower edge of a second row of shingles, the second flange having a plurality of first alignment pegs thereon for alignment of the slots in the second row of shingles. The first alignment pegs are longitudinally offset from the grooves in the lower flange by a distance of substantially one-half the separation distance between adjacent slots in the first row of shingles. The fixture further includes a second longitudinal panel hingedly mounted to the first longitudinal panel along a longitudinal axis, the second panel being folded down on top of the second row of shingles after they have been fastened to the roof, the second panel having an upper flange with an upper surface separated from the upper surface of the second flange by the row width dimension, for abutting with the lower edge of a third row of shingles, the upper flange having a plurality of second alignment pegs thereon for alignment of the slots in the third row of shingles. The second alignment pegs are longitudinally aligned with the grooves in the lower flange. In this manner, the second and third rows of shingles can be aligned with the first row, providing a more efficient means to lay roofing shingles than has been available in the prior art. The fixture is made of aluminum and is therefore light in weight and easy to carry and use.

DESCRIPTION OF THE FIGURES

These and other objects, features and advantages will be more fully appreciated with reference to the accompanying figures.

DISCUSSION OF THE PREFERRED EMBODIMENT

Figure 1:
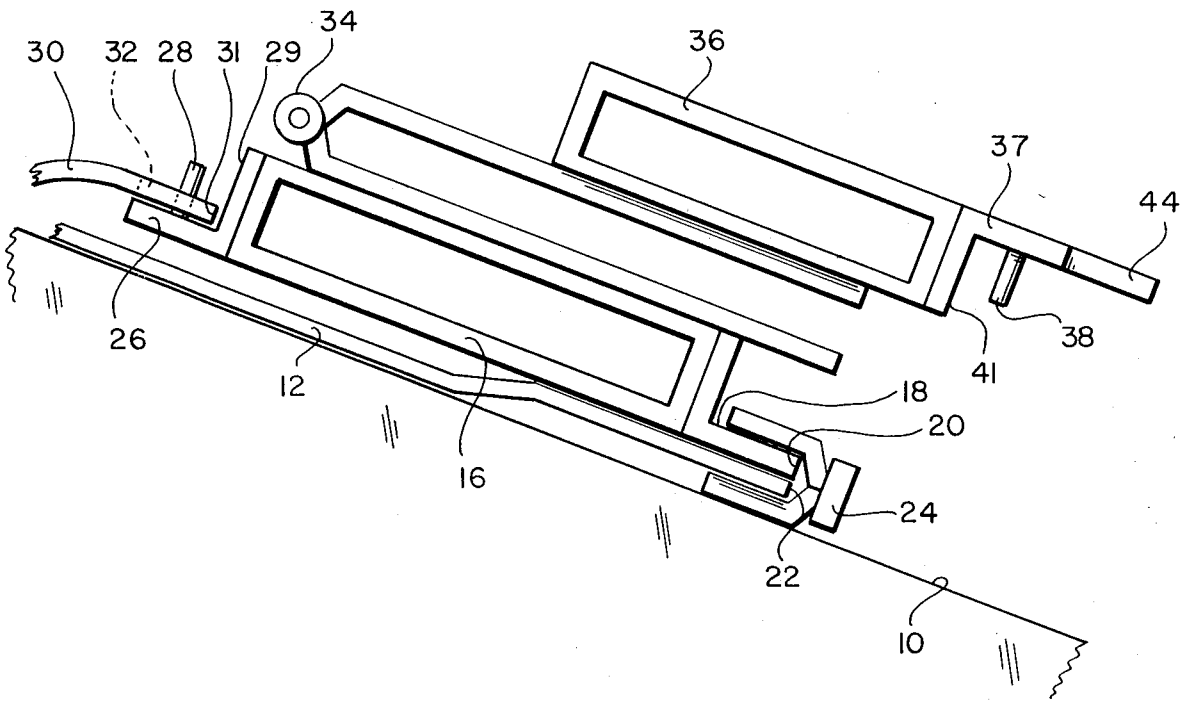
FIG. 1 is a side view of the invention in its folded state when the second row of shingles is being aligned with the first row.
Figure 2:
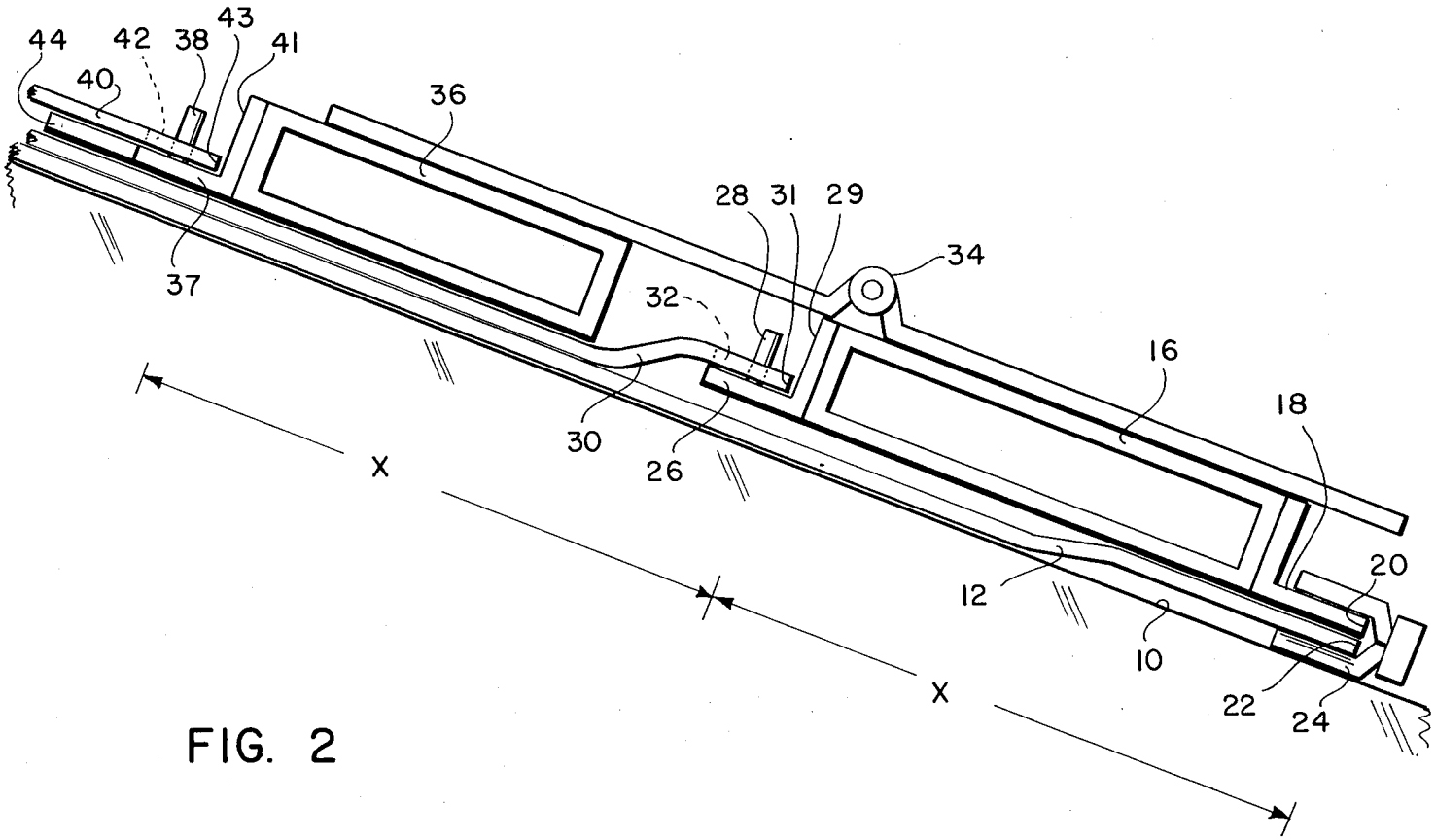
FIG. 2 is a side view of the invention in its unfolded state when the third row of shingles is being aligned with the first and second rows.
Figure 3:
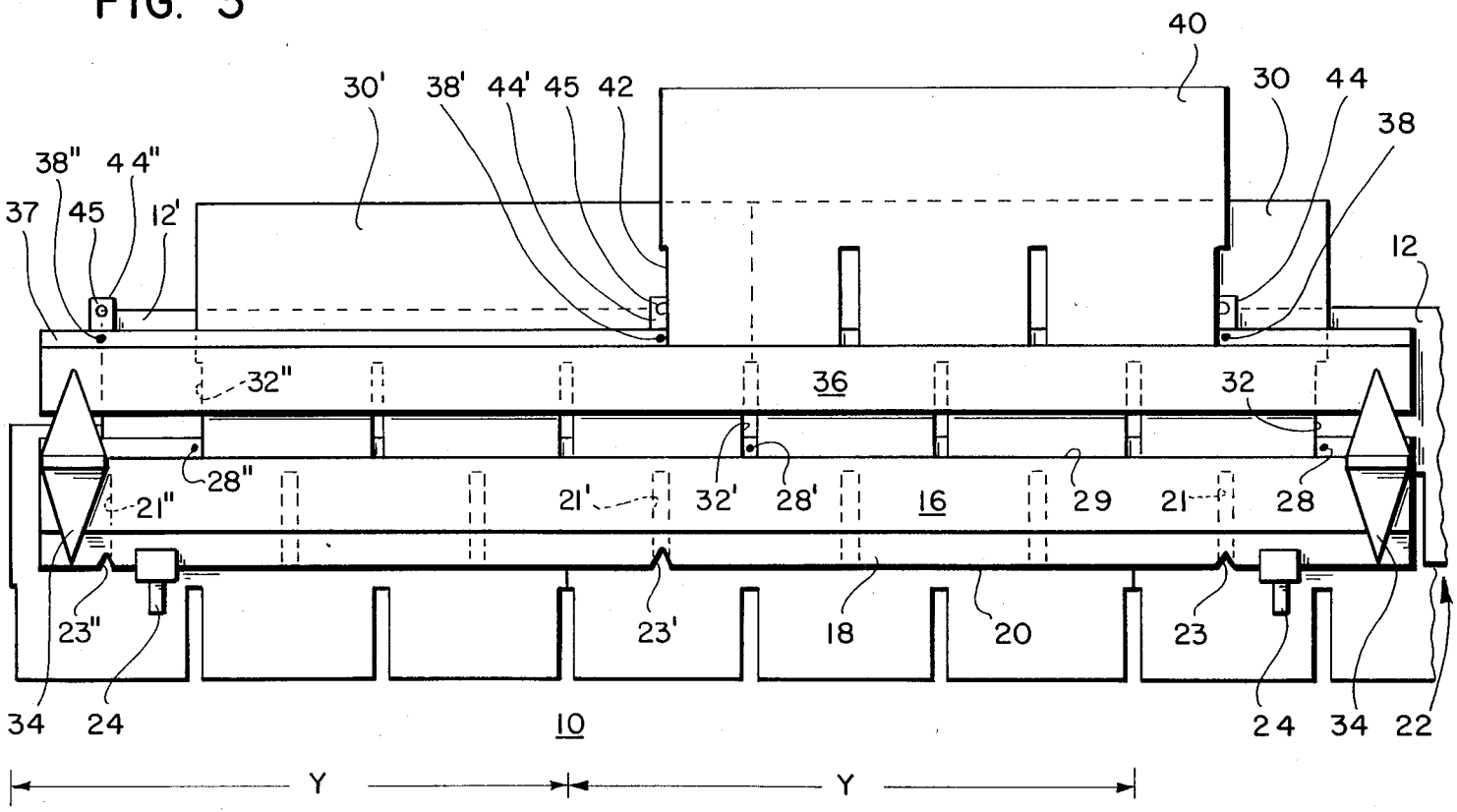
FIG. 3 is a top view of the invention in its unfolded state, showing the relative position of the first, second and third rows of shingles which are being mutually aligned by the invention.

FIGS. 1, 2 and 3 show various views of the double row shingle alignment fixture invention for aligning rows of roofing shingles.

FIG. 1 shows a first longitudinal panel 16 having a lower flange 18 with a lower edge 20 adapted to be aligned by means of clamps 24 with the lower edge 22 of a first row of shingles 12 and 12'. FIG. 3 shows the lower flange 18 has a plurality of grooves 23, 23' and 23'' therein mutually separated by a distance of Y which equals three feet and one-eighth inch, for alignment with the slots 21, 21' and 21'', respectively, in the first row of shingles 12.

The first longitudinal panel further includes a second flange 26 on the opposite side thereof, having an upper surface 29 separated from the lower edge 20 of the lower flange 18 by a row width dimension X, for abutting with the lower edge 31 of a second row of shingles 30. The value of X is typically five or six inches. The second flange 26 has a plurality of first alignment pegs 28, 28' and 28'' thereon for alignment of the slots 32, 32' and 32'', respectively, in the second row of shingles 30 and 30'. For shingles which are nominally three feet long with a plus tolerance of one-eighth of an inch, the separation distance Y of the first alignment pegs 28 is three feet and one-eighth inch. The length of the first longitudinal panel 16 can be varied to accommodate one, two three or more of such shingles in a row. The embodiment shown in FIG. 3 has three of the first alignment pegs 28 thereon, allowing two shingles to be laid down in the second row 30.

The first alignment pegs 28 are longitudinally offset from the grooves 23 in the lower flange 18 by a distance of substantially one-half the separation distance between adjacent ones of the slots 21 in the first row of shingles 12. If the shingle has a nominal length of three feet and there are three rectangular portions projecting from the upper body of the shingle, as shown in FIG. 3, which are mutually separated by slots 21 which are located on one foot centers, then the offset distance between the first alignment pegs 28 and the grooves 23 in the lower flange 18 is six inches.

FIG. 2 shows a second longitudinal panel 36 hingedly mounted by means of the hinges 34 to the first longitudinal panel 16 along a longitudinal axis, the second panel 36 being folded down on top of the second row of shingles 30 after they have been fastened to the roof 10. The second panel has an upper flange 37 with an upper surface 41 separated from the upper surface 29 of the second flange 26 by the row width dimension X, for abutting with the lower edge 43 of a third row of shingles 40. The upper flange 37 has a plurality of second alignment pegs 38, 38' and 38" thereon for alignment of the slots 42 in the third row of shingles 40, as shown in FIG. 3. The mutual separation distance between the second alignment pegs 38 is the same as the mutual separation distance between the first alignment pegs 28.

As is seen in FIG. 3, the second alignment pegs 38 are longitudinally aligned with the grooves 23 in the lower flange 18 so that the third row of shingles 40 will be aligned with the first row of shingles 12.

As is shown in FIG. 3, the plurality of first alignment pegs 28 is mutually separated by a distance substantially equal to the sum of the nominal longitudinal length of a shingle plus its maximum tolerance value.

FIG. 3 further shows that the plurality of second alignment pegs 38 is also mutually separated by a distance substantially equal to the sum of the nominal longitudinal length of a shingle plus its maximum tolerance value.

A further feature of the invention is shown in FIG. 3, wherein a plurality of alignment tabs 44, 44' and 44" mounted at the upper flange 37 and mutually separated by a distance equal to the sum of the nominal longitudinal length of the shingle plus its maximum tolerance value, is used for detecting shingles which are longitudinally too long. For example, if the shingle 12' in the first row 12 is greater than the maximum allowable longitudinal dimension of the nominal length of three feet plus the tolerance value of one-eighth of an inch, this can be seen by sighting through the hole 45 in the tab 44" which is centered at the maximum allowable longitudinal dimension for a shingle.

The fixture can be made of aluminum to give it a light weight which will enable it to be easily carried and used.

The resultant invention provides an improved way to align roofing shingles when they are being laid down which is more efficient to use than has been available in the prior art.

Although a specific embodiment of the invention has been disclosed, it will be understood by those workers having skill in the art that changes can be made to the dimensions and composition of the elements without departing from the spirit and the scope of the invention.

What is claimed is:

1. A double row shingle alignment fixture for aligning rows of roofing shingles, comprising:

a first longitudinal panel having a lower flange with a lower edge adapted to be aligned with a lower edge of a first row of shingles, said lower flange having a plurality of grooves therein for alignment with slots in said first row of shingles;

said first longitudinal panel further including a second flange on an opposite side thereof, having an upper surface separated from said lower edge of said lower flange by a row width dimension, for abutting with a lower edge of a second row of shingles, said second flange having a plurality of first alignment pegs thereon for alignment with slots in said second row of shingles;

said first alignment pegs being longitudinally offset from said grooves in said lower flange by a distance of substantially one-half the separation distance between adjacent ones of said slots in said first row of shingles;

a second longitudinal panel hingedly mounted to said first longitudinal panel along a longitudinal axis, said second panel being folded down on top of said second row of shingles after being fastened to the roof, said second panel having an upper flange with an upper surface separated from said upper surface of said second flange by said row width dimension, for abutting with a lower edge of a third row of shingles, said upper flange having a plurality of second alignment pegs thereon for alignment with slots in said third row of shingles; and said second alignment pegs being longitudinally aligned with said grooves in said lower flange, whereby said second and third rows of shingles can be aligned with said first row.

2. The apparatus of claim 1, wherein said plurality of first alignment pegs are mutually separated by a distance substantially equal to the sum of a nominal longitudinal length of a shingle and a maximum tolerance value.

3. The apparatus of claim 2, wherein said plurality of second alignment pegs are mutually separated by a distance substantially equal to the sum of a nominal longitudinal length of a shingle and a maximum tolerance value.

4. The apparatus of claim 3, which further comprises a plurality of alignment tabs mounted at said upper flange and mutually separated by a distance equal to the sum of a nominal longitudinal length of the shingle and a maximum tolerance value, for detecting shingles which are longitudinally too long.

5. The apparatus of claim 4, wherein said fixture is aluminum.

6. A double row shingle alignment fixture for aligning rows of roofing shingles, comprising:

a first longitudinal panel having a lower edge adapted to be aligned with a lower edge of a first row of shingles, said lower edge having a plurality of grooves therein for alignment with slots in said first row of shingles;

said first longitudinal panel further including a flange on the opposite side thereof, having an upper surface separated from said lower edge by a row width dimension, for abutting with a lower edge of a second row of shingles, said second flange having a plurality of first alignment pegs thereon for alignment with slots in said second row of shingles;

said first alignment pegs being longitudinally offset from said grooves;

a second longitudinal panel hingedly mounted to said first longitudinal panel along a longitudinal axis, said second panel being folded down on top of said second row of shingles after being fastened to the roof, said second panel having an upper flange with an upper surface separated from said upper surface of said second flange by said row width dimension, for abutting with a lower edge of a third row of shingles, said upper flange having a plurality of second alignment pegs thereon for alignment with slots in said third row of shingles; and said second alignment pegs being longitudinally offset from said first alignment pegs, whereby said second and third rows of shingles can be aligned with said first row.

7. The apparatus of claim 6, wherein said plurality of first alignment pegs are mutually separated by a distance substantially equal to the sum of a nominal longitudinal length of a shingle and a maximum tolerance value.

8. The apparatus of claim 7, wherein said plurality of second alignment pegs are mutually separated by a distance substantially equal to the sum of a nominal longitudinal length of a shingle and a maximum tolerance value.

9. The apparatus of claim 8, which further comprises:

a plurality of alignment tabs mounted at said upper flange and mutually separated by a distance equal to the sum of a nominal longitudinal length of the shingle and a maximum tolerance value, for detecting shingles which are longitudinally too long.

10. The apparatus of claim 9, wherein said fixture is aluminum.

* * * * *